US005950580A

United States Patent [19]

Birckbichler

[11] Patent Number: 5,950,580

[45] Date of Patent: Sep. 14, 1999

[54] RECIPROCATING ENGINE WITH CRANKPLATE

[75] Inventor: Richard C. Birckbichler, Auburn, Ga.

[73] Assignee: Birckbichler Engine Research, Inc., Kennesaw, Ga.

[21] Appl. No.: 09/049,647

[22] Filed: Mar. 27, 1998

[51] Int. Cl.[6] ..... F02B 75/18

[52] U.S. Cl. ..... 123/56.2

[58] Field of Search ..... 123/56.2, 56.9, 123/655, 56.6, 56.5, 55.3, 53.6, 58.1–58.9

[56] References Cited

U.S. PATENT DOCUMENTS

| | | | |
|---|---|---|---|
| 1,147,313 | 7/1915 | Desort . | |
| 1,207,846 | 12/1916 | Bradford . | |
| 1,261,111 | 4/1918 | Fasey et al. . | |
| 1,629,686 | 5/1927 | Dreisbach . | |
| 1,838,974 | 12/1931 | Williams . | |
| 1,999,451 | 4/1935 | Finlay | 123/56.2 |
| 2,027,076 | 1/1936 | Volliman | 123/56.5 |
| 2,083,730 | 6/1937 | Michell | 123/56.5 |
| 2,152,811 | 4/1939 | Michell | 123/56.5 |
| 2,856,781 | 10/1958 | Forbes | 74/56 |
| 3,745,887 | 7/1973 | Striegl | 92/146 |
| 4,489,682 | 12/1984 | Kenny | 123/56.6 |
| 4,610,223 | 9/1986 | Karlan | 123/56.9 |
| 4,886,024 | 12/1989 | Meredith | 123/56.5 |
| 5,269,193 | 12/1993 | Rabinow | 123/56.5 |
| 5,437,251 | 8/1995 | Anglim et al. | 123/65 S |
| 5,452,689 | 9/1995 | Karlan | 123/56.2 |
| 5,517,953 | 5/1996 | Wiesen | 123/56.2 |
| 5,749,337 | 5/1998 | Palatov | 123/56.2 |

FOREIGN PATENT DOCUMENTS

| | | | |
|---|---|---|---|
| 000024253 | 2/1914 | Norway | 123/56.2 |
| 3302 | of 1910 | United Kingdom | 123/56.2 |

OTHER PUBLICATIONS

K.S. Cullom, Technical Development Report No. 4, Civil Aeronautics Authority U.S.A., Jan. 1939.

*Primary Examiner*—Noah P. Kamen
*Assistant Examiner*—Jason Benton
*Attorney, Agent, or Firm*—Bernstein & Assoc. PA

[57] ABSTRACT

An internal combustion engine (12) having a rotating crankplate (33) mounted underneath the cylinders (45) and connected to the pistons (54) by connecting rods (72) that are constrained to move in a straight line up and down according to the movement of the pistons (54). The crankcase (15) has a cylindrical inner wall (18) and a cylindrical outer wall (21) that each have opposing guide rails (108) defined therein. The guide rails (108) constrain the motion of the connecting rods (72) to motion in a single plane. The cylinders (45) are stationary and the connecting rods (72) can only move up and down. The force of the connecting rods (72) on an inclined cam surface on the cam lobe (90) during the power stroke causes the crankplate (33) to rotate.

30 Claims, 5 Drawing Sheets

RECIPROCATING ENGINE WITH CRANKPLATE

FIELD OF THE INVENTION

The present invention relates to internal combustion engines, and more particularly to a crank plate/connecting rod combination for an internal combustion engine.

BACKGROUND OF THE INVENTION

In the conventional reciprocating engine a connecting rod links the piston to a crank on the crankshaft. The connecting rod turns the crank during the power stroke and the crank then continues to rotate and drives the piston back up the cylinder. In this way, the crankshaft converts the movement of the pistons into rotary power. In order to turn the crank, the connecting rod has to be slanted in the delivery of combustion energy to the crankshaft. At the moment when the greatest cylinder pressures are being exerted, the connecting rods are slanted between the pistons and the crank. This slant of the connecting rod reduces the efficiency of the transmission of energy.

The prevailing design of automobile engines is to shorten the stroke and to repeat the cycle faster to compensate for deficiencies inherent in the slanted rod design. However, shortening the stroke and repeating the cycle faster limits the ability of the engine to fully utilize the flame spread pattern during combustion. Accordingly, the thermal efficiency of the engine is reduced.

There have also been attempts at improving engine performance by other methods such as electronic controls, freer airflow patterns, and fuel injection. However, the increases in performance are moving forward in relatively small strides because of the limitations of the connecting rod/crank design.

What is needed is a reciprocating engine that provides an improved connecting rod/crank and crankcase design for transmitting the movement of pistons into rotary power.

SUMMARY OF THE INVENTION

The present invention solves the above described problems by providing an internal combustion engine having a revolving crankplate that replaces the conventional slanted connecting rod/crankshaft combination. Generally described, the present invention provides an internal combustion engine having a crankplate/connecting rod combination that improves the efficiency and performance of an internal combustion engine.

In a preferred embodiment, the present invention provides an internal combustion engine having a crankcase with a plurality of stationary cylinders mounted above the crankcase. A plurality of pistons is disposed inside the cylinders. The pistons move up and down through the compression and power stages of the cycle. The exhaust and intake portion of the cycle take place while the pistons are motionless. The cylinders are stationary and positioned equidistant around the circumference of a round crankcase.

A round crankplate is positioned below the cylinders and attaches to a set of connecting rods. The connecting rods connect at one end to the pistons in the conventional manner. The other end of the connecting rod is formed in the shape of an inverted U with a central bearing mounted on an axle extending through the legs. Additional bearings are positioned on the axle outside of the legs.

The crankplate has a curved surface capable of engaging with the bearings on the connecting rods such that the position of the pistons and the position of the crankplate are interrelated. The curved surface is formed on an upstanding cylindrical wall formed on the crankplate. The wall has a first end and a second end. The first end of the wall intersects the crankplate, and the second end of the wall defines a curved surface. The second or curved end of the wall has a top portion with a width greater than the remainder of the wall such that the wall and the top portion form a T-shaped member.

The U-shaped end of the connecting rod fits over the T-shaped member such that the central bearing is stationary but moves up and down according to the contours of the curved surface on the upstanding wall. Accordingly, the connecting rod exerts a force against the curved surface during the power stroke and as the crankplate continues to rotate the curved surface drives the piston back up the cylinder.

The crankcase has an inner wall and an outer wall with the walls formed in the shape of concentric circles. The inner wall and the outer wall have a set of guide rails that are attached such that the guide rails on the inner wall face the guide rails on the outer wall. The bearings on the outside of the connecting rod are disposed between the guide rails on the crankcase such that the motion of the connecting rods is constrained to a straight path.

The end of the crankshaft is disposed inside an open space formed inside the area defined by the inner wall of the crankcase. The crankshaft is mechanically coupled to a blower, a pair of fuel injection pumps, and an oil pump. The crankshaft drives these accessories at different speeds depending on whether or not gear drives are used between the crankshaft and the respective drive shafts for the accessories.

In operation, each piston fires twice for each revolution of the crankshaft. Starting at top dead center ("TDC"), the combustion chamber has been compressed to the point where the temperature inside the combustion chamber is high enough to ignite fuel that is direct injected into the cylinder. The direct injection of fuel into the combustion chamber is controlled by a pair of five cylinder fuel injection pumps that run at the same rpm as the engine. Once the fuel ignites, the resulting power stroke drives the piston and connecting rod downward. As a result the connecting rod causes a downward force on the cam lobe which causes the crankplate to rotate. The guide rails constrict the movement of the connecting rods to a strictly vertical travel. At the bottom dead center ("BDC") position the piston stops moving for a short period of time until the exhaust gases have been purged from the cylinder and a new charge of air has been drawn into the cylinder. Next, the upward slope of the cam lobe causes the connecting rod to push the piston up into the cylinder to begin the compression stroke. The cam lobe is designed to cause a short pause at TDC to allow for maximum flame spread just prior to letting the piston travel downward on the power stroke.

The position of the piston inside the cylinder during each part of the work cycle is determined by what part of the cam lobe is in contact with the connecting rod. During normal operation at least two pistons are on the power stroke at any given point in time.

Accordingly, the present invention provides a direct injected, internal combustion engine having a connecting rod/crankplate assembly that improves efficiency and performance.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
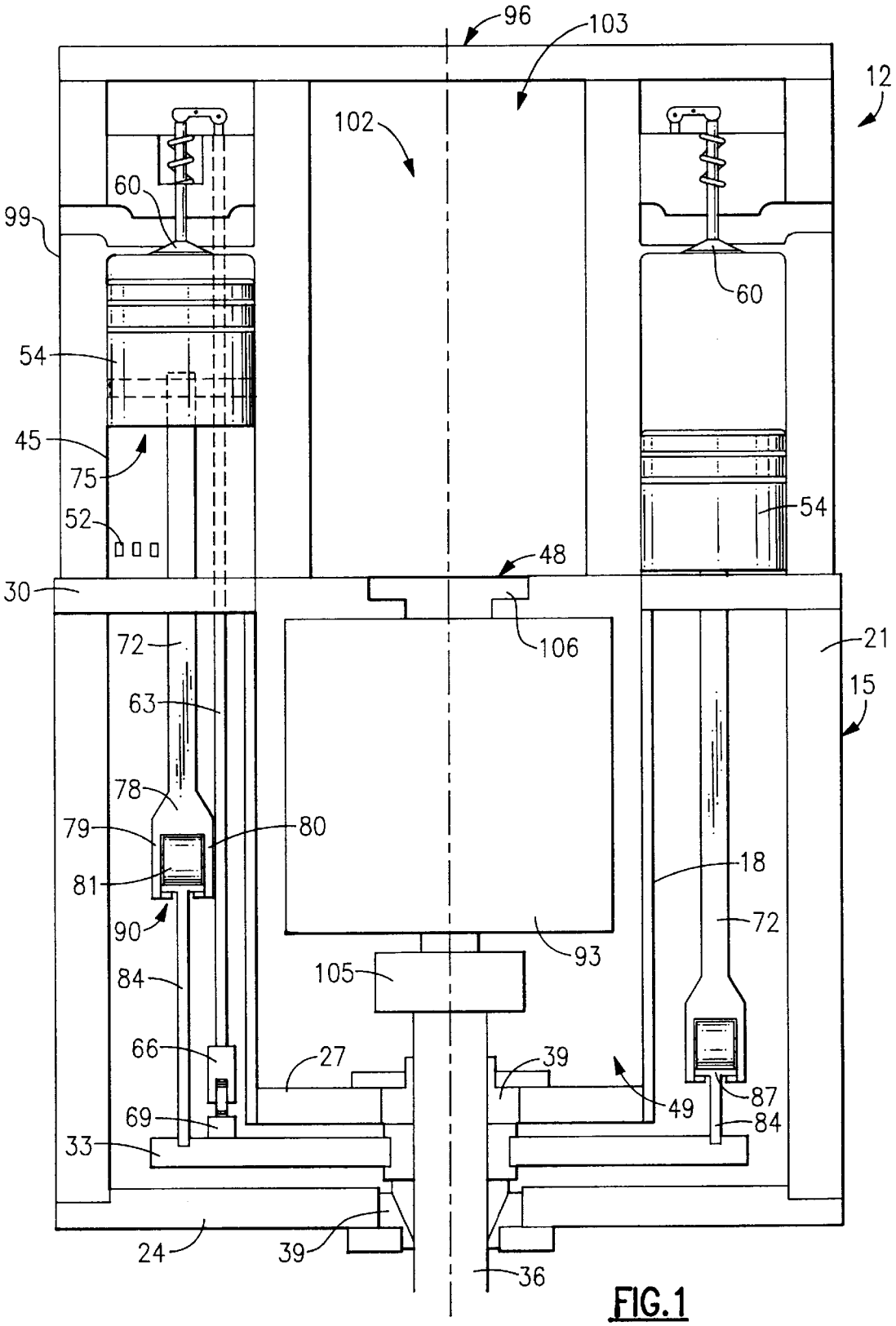
FIG. 1 is a front cutaway elevation view of the crankcase of the present invention.

In FIG. 1, an internal combustion engine 12 has a crankcase 15 that has an inner wall 18, an outer wall 21, a bottom plate 24, an intermediate plate 27, and a top plate 30. The inner wall 18 and outer wall 21 are formed by concentric circles (best shown in FIG. 3). A crankplate 33 is attached to a crankshaft 36 that extends through openings in the bottom plate 24 and the intermediate plate 27. The crankplate 33 and the crankshaft 36 rotate inside the openings in the bottom plate 24 and the intermediate plate 27. Cup and cone bearings 39 are positioned inside openings in the bottom plate 24 and the intermediate plate 27 to enable the crankplate 33 and the crankshaft 36 to rotate inside the crankcase 15. The bearings 39 are sealed to prevent oil from leaking out of the crankcase 15. The bearings 39 are preloaded to eliminate motion on the horizontal and vertical axes and to permit rotational motion only. This constraint on the motion of the crankplate 33 enables the crankplate 33 to perform the dual functions of flywheel and the conventional crankshaft that it replaces.

The top plate 30 attaches to the outer wall 21. The top plate 30 has five openings 42 (shown in FIG. 2) for positioning of the cylinders 45. The five cylinders 45 are positioned equidistant from each other around the circumference of the crankcase 15. The top plate 30 has a central opening 48 that leads to a space 49 inside the center of the crankcase 15. The inner wall 18 borders the space 49 and extends to a point located just above the crankplate 33 in the crankcase 15 where it terminates at the intermediate plate 27. The intermediate plate 27 is machined to accept the top cup and cone bearing 39. The crankshaft 36 extends into the space 49 and is fitted at this point with an oil seal (not shown) to eliminate leakage from the crankcase 15 into this space 49.

The cylinders 45 are mounted around the circumference and above the crankcase 15 as described above. The cylinders 45 are preferably constructed of a high nickel content, steel pipe that is finished on the inside and that is sized to seal properly with the piston-ring assembly. The cylinders 45 have a series of intake openings 52 bored through the walls such that the pistons 54 are capable of acting as a sliding valve. In order to do so, once the piston 54 reaches bottom dead center (hereafter referred to as "BDC"), the piston 54 clears the openings 52 which enables pressurized air from the surrounding area to enter the inside of the cylinder 45. The fresh charge of air enters the cylinder 45 and helps to purge the exhaust gases. The piston 54 pauses at BDC until the exhaust gases are allowed to escape. Next, an exhaust valve 60 closes and the piston 54 begins to move up into the cylinder 45. During intake while the piston 54 is motionless, a charge of air is allowed to recharge the cylinder 45 so that air will be available when the piston 54 starts moving back up into the cylinder 45.

The cylinders 45 are stationary, and are preferably positioned at equidistant (seventy-two degree intervals for five cylinders) intervals around the crankcase 15. Each cylinder 45 is inserted into the opening 42 and is secured with bolts and clips (not shown). The cylinders 45 are sealed with "O" rings that are fitted into an external groove on the cylinder 45. Each of the cylinders 45 is equipped with a cylinder head, which is secured to the cylinder 45 with bolts and clips. The joint of the head and the cylinder 45 is sealed with a copper "O" ring compressed in a groove in the head. Mounted in the center of the head is the exhaust valve 60 that is actuated by a rocker arm 61 and pushrod 63. The pushrod 63 is controlled by a roller bearing 66 disposed at the end of the rod 63 that engages with a cam surface 69 (best shown in FIG. 4) on the crankplate 33.

The pistons 54 move in response to a connecting rod 72 that attaches to the crankplate 33. The top end 75 of the connecting rods 72 are attached to the piston 54 with a wrist pin 76 (shown in FIG. 7) as is known to those skilled in the art. The wrist pin allows a free-floating effect for the connection between the piston 54 and the connecting rod 72. The lower end 78 of the connecting rod 72 is Ushaped with a first leg 79 and a second leg 80. A central bearing 81 is mounted on an axle 82 that extends from outside the first leg 79 through the second leg 80. Additional bearings 83 (shown in FIG. 7) are mounted on the axle 82 (best shown in FIG. 8) outside the legs. The bearings are preferably roller bearings, and this roller bearing design is utilized wherever possible to reduce friction in the engine 12. The lower end 78 of the connecting rod fits over an upstanding cylindrical wall 84 that extends around the perimeter of the crankplate 33. A top portion 87 is attached or integrally formed with the upstanding wall 84 to form a cam lobe 90.

The height of the cam lobe 90 varies around the circumference of the crankplate 33 according to a curved pattern. As shown in FIG. 1, where the connecting rod 72 on the left is positioned much higher than the connecting rod positioned on the right, the cam lobe 90 determines the position of the piston 54 inside the cylinder 45. Accordingly, the cam lobe 90/crankplate 33 combination makes it possible to control the piston speed (by varying the height of the cam lobe 90 and the slope of the curve on the cam lobe 90). Also, the compression stroke, dwell time (after ignition for flame spread) and exhaust timing for the cycle are determined by the profile of the cam lobe 90.

With the cam lobe 90 disposed around the perimeter of the crankplate 33, a great deal of torque is generated and applied to the crankshaft 36. The rotating mass of the complete crankplate 33/cam lobe 90 assembly generates a flywheel effect that provides for smooth application of power.

A mechanical blower 93 is disposed inside the center of the crankcase 15 and provides both cooling air and pressurized air for charging the cylinder 45 prior to a cycle. The blower 93 obtains air from the open top end 96 (shown in FIGS. 1 and 3) and forces the air to circulate around the cylinders 45 which are encased on the outside by a thin shield 99 to allow a build up of pressure within a confined area. This pressure is essential to the operation of the engine 12 as it provides intake air to the cylinders 45 for combustion.

The mechanical blower 93, two fuel injection pumps 102 and 103, and an oil pump 105 are all driven from the crankshaft 36 that extends into the space 49 in the center of the structure outside the crankcase 15. The drive shafts (not shown) for the blower 93 and the pumps 102, 103 and 105 are coupled to the crankshaft 36 and may be driven at the crankshaft 36 rpm or may be driven at other speeds through the use of a gear drive 106 as is evident to those skilled in the art.

The cylinders 45 are preferably direct injected with fuel once the air inside the cylinders 45 has been compressed such that the temperature inside the combustion chamber is sufficiently elevated to the point where fuel that is direct injected into the cylinder 45 will ignite.

The fuel injection pumps 102 and 103 are preferably five cylinder fuel injection pumps running at engine rpm. The pumps 102 and 103 inject fuel into the cylinders 45 twice during each rotation of the crankplate 33.

The engine is preferably lubricated by a dry sump system. The oil is stored in a reservoir (not shown) at a remote location and by means of flexible tubing is routed to the inlet of the oil pump 105 located in the center of the crankcase 15. The oil is conducted from the exit port of the pump 105 through a series of tubes and holes bored in the crankcase 15 walls to flow through all the stationary bearings 39 and through spray nozzles on moving bearings 66, 81, and 83. Oil collects in a recovery sump (not shown) at the lowest point of the crankcase 15 and is returned to the reservoir by a separate low pressure, high volume, pump (not shown) to complete the cycle. The additional pump may not be required as the pressures inside the crankcase 15 may be sufficient to convey the oil back to the reservoir without a separate pump.

Figure 2:
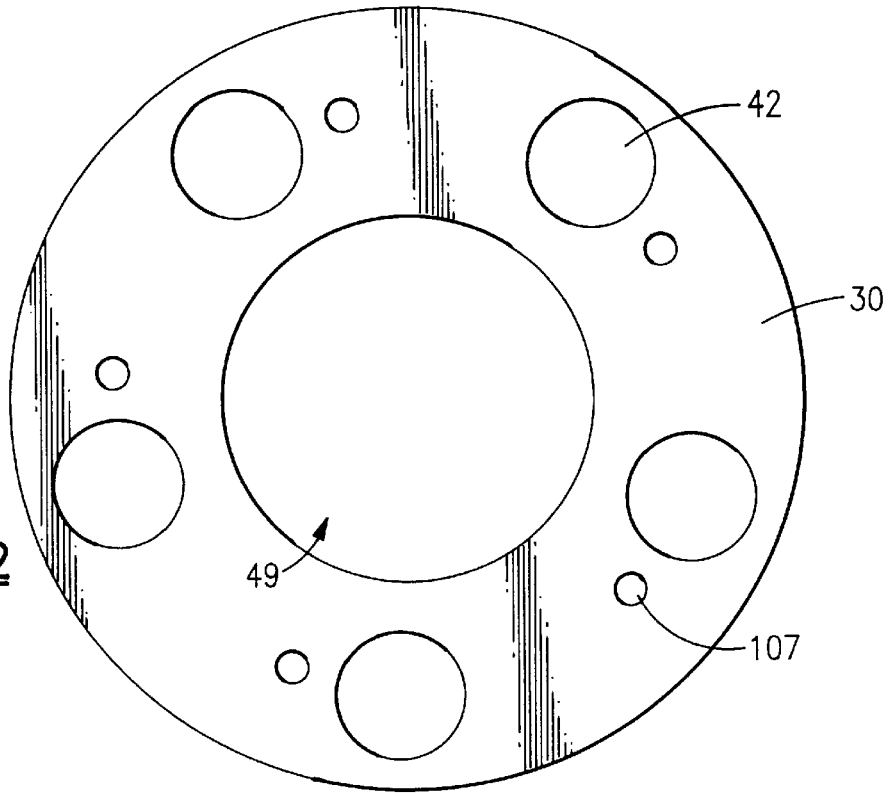
FIG. 2 is a top plan view of the crankcase.

Referring to FIGS. 1 and 2, the top plate 30 has openings 42 positioned around its circumference for access to the cylinders 45. The openings 42 are equally spaced in intervals of approximately seventy-two degrees to accommodate five cylinders 45. The inner wall 18 and outer wall 21 are formed in the shape of concentric circles and the inner wall 18 borders the open space 49 where the accessories are located outside of the crankcase 15. Additional openings 107 provide access to the pushrods 63 that actuate the exhaust valves 60.

Figure 3:
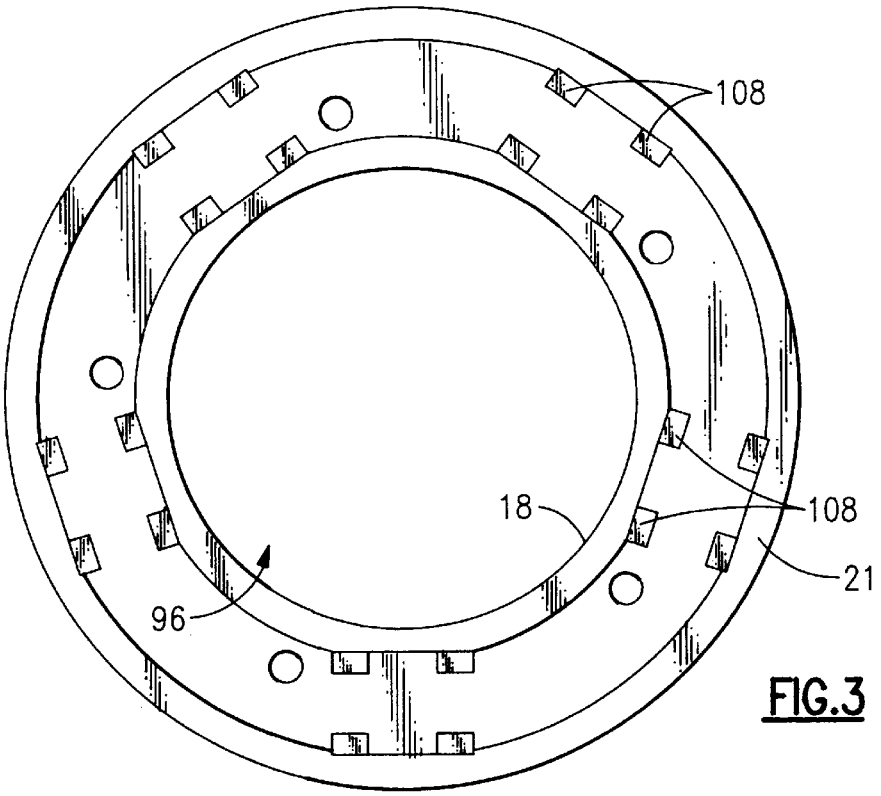
FIG. 3 is a top cutaway plan view of the crankcase.

Referring to FIGS. 1 and 3, pairs of guide rails 108 are positioned inside the crankcase 15 and are attached to the inner wall 18 and the outer wall 21 of the crankcase 15. The guide rails 108 face each other and are slightly offset from the curvature of the walls 18 and 21 so that the rails are substantially parallel with one another and squared up with the rails 108 that they face. The rails 108 provide a track for the bearings 83 (best shown in FIG. 10) that are positioned on the outside of the connecting rods 72. Since the cylinders 54 are stationary and the connecting rods 72 are restricted to purely vertical motion by the guide rails 108, the pistons 54 and connecting rods 72 are always in alignment. The only motion allowed by the guide rails 108 is reciprocal motion in a straight line with the pistons 54.

Accordingly, the only rotating part is the crankplate 33 that rotates because of the downward force of the pistons 54 transmitted to the cam lobe 90 by the connecting rod 72 during the power stroke.

Figure 4:
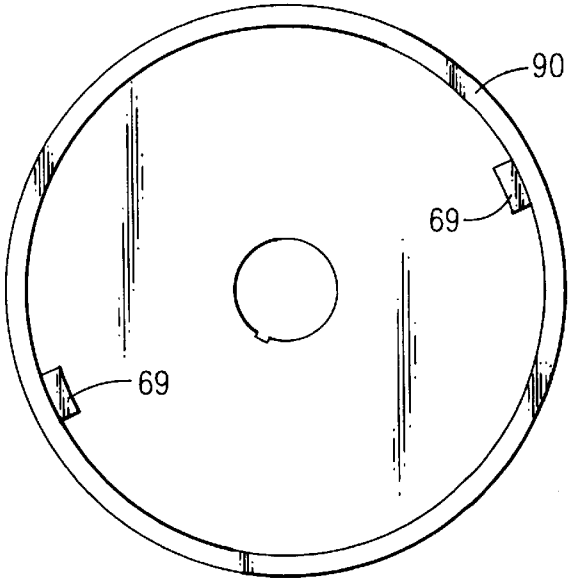
FIG. 4 is a top plan view of the crankplate of the present invention.

Referring to FIG. 1 and FIG. 4, the cam lobe 90 is disposed around the outside edge of the crankplate 33. The cam surface 69 for engaging with the pushrod 63 to open the exhaust valve 60 at the appropriate time during the cycle is positioned inside the cam lobe 90 on the crankplate 33. As the crankplate 33 turns, the cam surface 69 rotates into contact with the bearing 66 which lifts the push rod 63 for the period of revolution that the cam surface 69 is underneath the rod 63.

Figure 5:
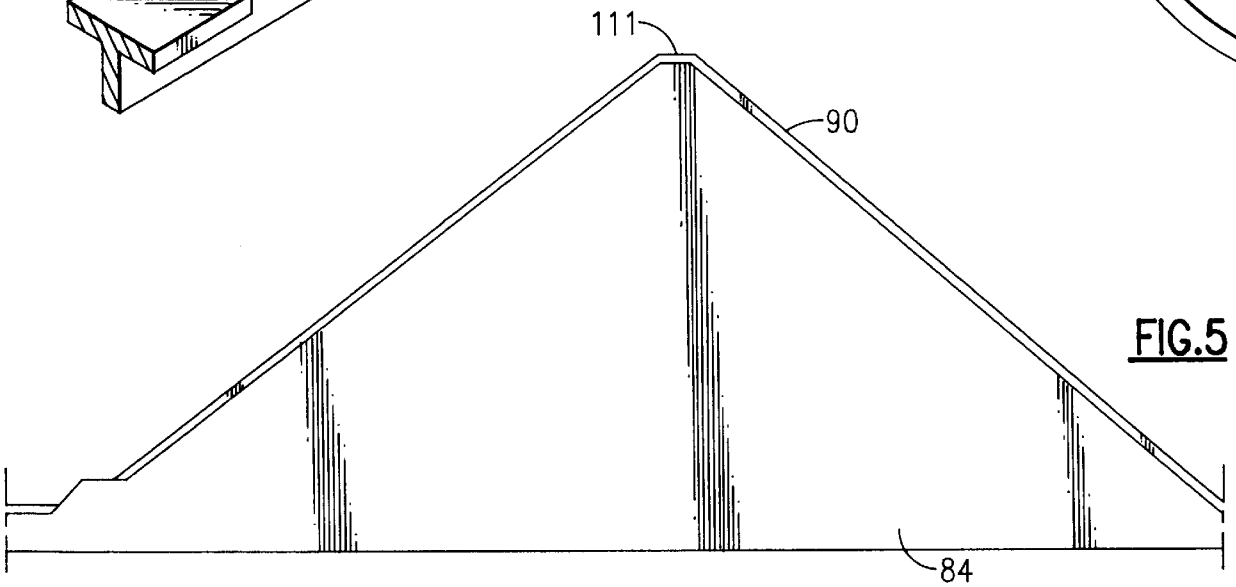
FIG. 5 is a partial side elevation view of the crankplate of the present invention.

In FIG. 5, the cam lobe 90 is shown for half of a cycle. The connecting rod 72 travels upward due to the slope of the cam lobe 90 which drives the piston 54 into the cylinder 45. When the piston 54 reaches top dead center (hereinafter "TDC") at the apex of the lobe 90 shown in FIG. 5., ignition occurs and the flat portion 111 at the top indicates a lag time for maximum flame spread. Once the connecting rod 72 reaches the downslope, the power stroke is pushing the connecting rod 72 down into the cam lobe 90. Because the cam lobe 90 and the crankplate 33 cannot move in any direction except to rotate, the downward force of the connecting rod 72 during combustion causes the crankplate 33 to rotate. At any given point in time at least two pistons 54 are preferably engaged in some phase of the power stroke on the downward slope of the cain lobe 90.

Figure 6:
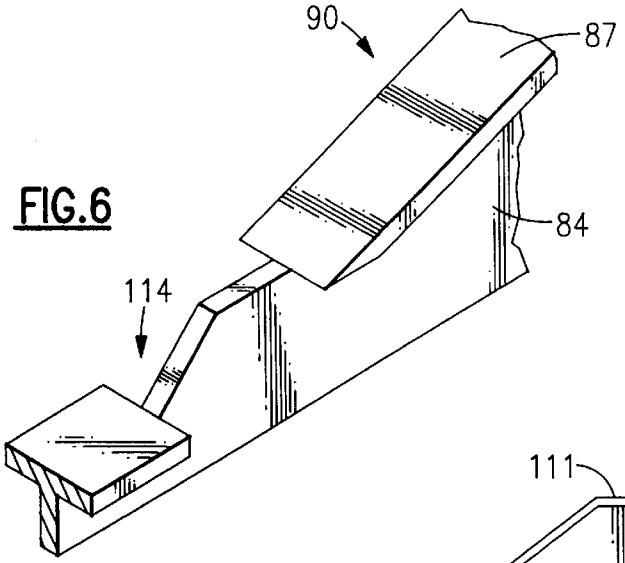
FIG. 6 is a detail view taken along line 6—6 in FIG. 5.

Referring to FIGS. 1, 2 and 6, the cam lobe 90 has an opening 114 which enables the connecting rod 72 to be removed from the crankplate 33 without taking the crankcase 15 apart. When the connecting rod 72 travels across the section of the cam lobe 90 having the opening during normal operation, the force between the bearing and the remaining portion of the upstanding cylindrical wall maintains contact between the bottom of the bearing and the portion of the wall. Accordingly, the connecting rod 72 will not "jump" off of the cam lobe 90. However, if the crankplate 33 is manually rotated to the point where the connecting rod 72 is aligned with the opening, the connecting rod 72 can be pulled straight up and off of the cam lobe 90. Accordingly, because the cylinder 45 is accessible through the openings 42 in the top plate 30 of the crankcase 15, an entire cylinder 45 can be removed from the engine 12 and replaced without taking the crankcase 15 apart.

Figure 7:
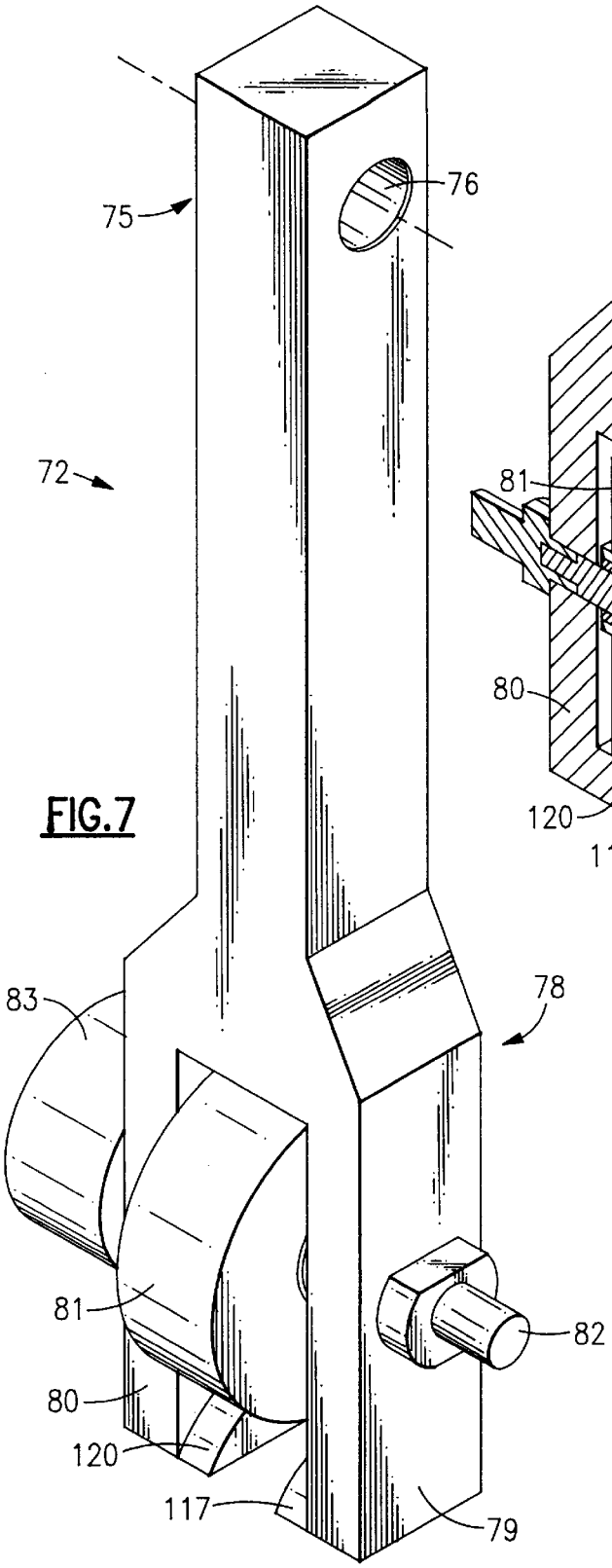
FIG. 7 is a p ersp ec tive view of the connec ting rod of the present invention.
Figure 8:
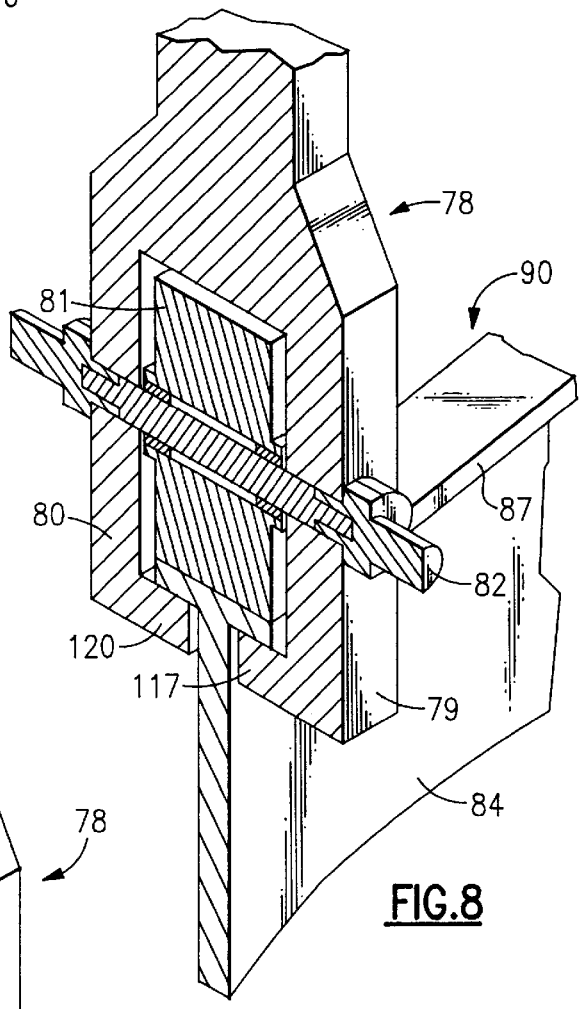
FIG. 8 is a cutaway perspective view of the connecting rod attaching to the crankplate.

Referring to FIG. 7, the legs 79 and 80 have stubs 117 and 120 that are curved such that the legs 79 do not bind up on the curvature of the cam lobe 90. The bearings 81 and 83 are preferably mounted on the common axle 82. Turning to FIG. 8, the U-shaped portion of the connecting rod 72 mounts onto the T-shaped cam lobe 90. The stubs 117 and 120 only make contact with the cam lobe 90 during startup. After startup, the central bearing 81 maintains pressure on the cam lobe 90 according to the position of the crankplate 33.

Figure 10:
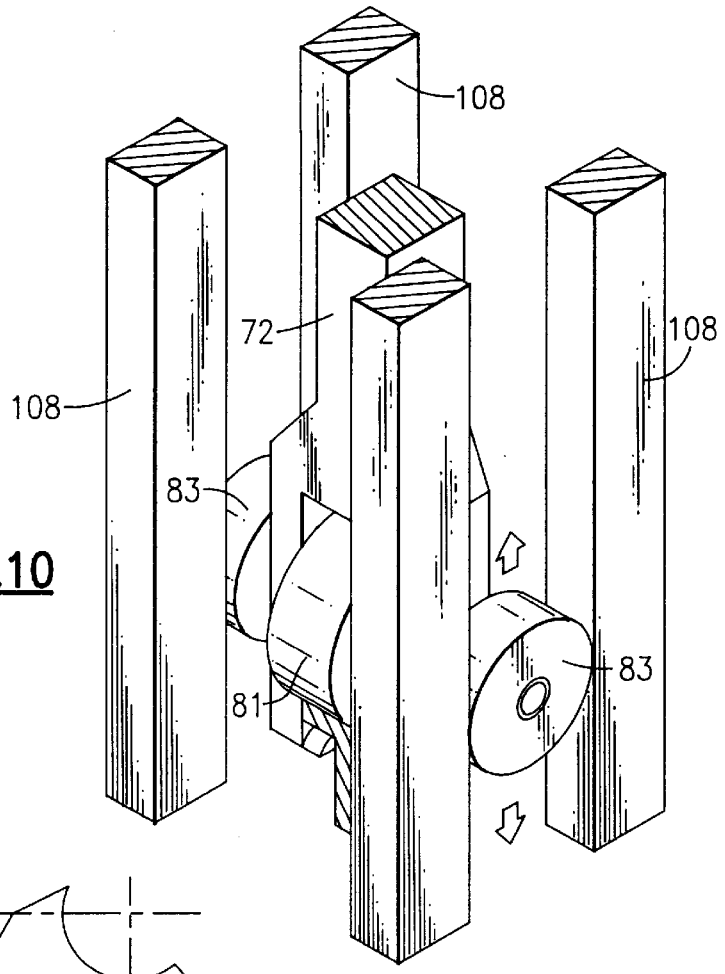
FIG. 10 is a partial perspective view of the connecting rod disposed inside the rails in the crankcase.
Figure 9:
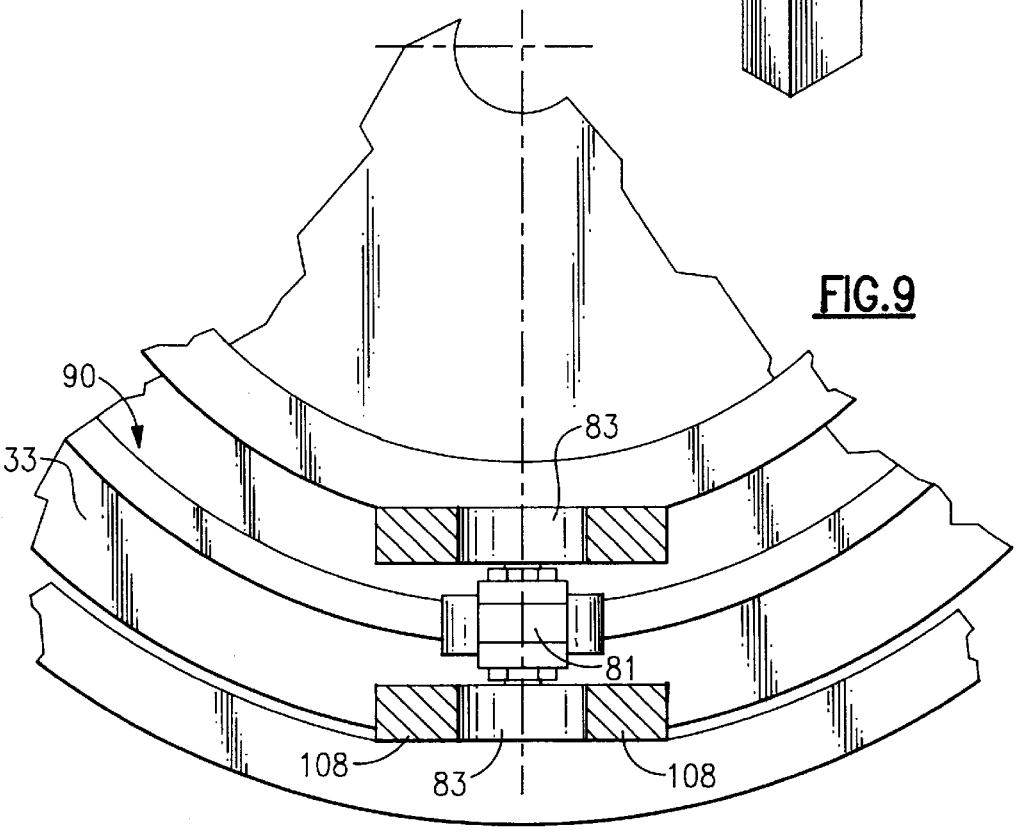
FIG. 9 is a cutaway top plan view of the connecting rod positioned inside the crankcase.

Referring to FIGS. 1, 9, and 10, the connecting rod 72 is captive within the guide rails 108, and as a result, the pistons 54 maintain alignment while the crankplate 33 revolves underneath the bearing 81 on the connecting rod 72.

In operation, each piston 54 for each of the five cylinders 45 fires twice per revolution of the crankplate 33. The exhaust and intake functions occur while the piston pauses near BDC. The compression stroke cycle occurs every time the piston moves from BDC to TDC. On the other hand, a power stroke occurs every time the pistons 54 go from TDC to BDC.

The engine preferably operates by direct injection of fuel into the combustion chamber by means of the five cylinder fuel injection pumps 102 and 103. The pumps 102 and 103 run at engine rpm and supply a charge of fuel to the combustion chamber at the end of every compression stroke for every piston 54. Accordingly, air alone is being compressed inside the cylinders 45 during the compression stroke, and then fuel is direct injected and ignites in the combustion chamber due to the temperature of the compressed air inside the cylinder.

The engine of the present invention offers several advantages over conventional engines including the fact that it generates greater torque. The amount of torque generated by an engine is directly proportional to the amount of horsepower according to the equation Torque X Rpm's divided by 5252.1 equals horsepower. The engine 12 of the present invention produces significant torque as it has an average moment of force greater than four times as long as any other automobile engine in production.

The crankplate 33/connecting rod 72 of the present invention is designed to maximize the conversion of the piston force into rotary force because the piston and connecting rod are maintained in alignment throughout the power stroke, the power stroke is long enough to allow the complete burning of fuel during the power stroke and before the exhaust valve opens, the combustion gases inside the cylinder are allowed to cool extensively due to expansion prior to exhausting, and the cooling air from the engine is used as combustion air to utilize the waste heat in a thermally efficient manner.

The shape of the cam lobe 90 provides for the timing for the different functions during the combustion cycle and may be adjusted according to the desired performance for the engine. In the preferred embodiment, at TDC the cam lobe 90 is straight for a short period so that the amount of energy captured from the combustion during the flame spread is maximized. When the piston 54 is at BDC it also lingers for a time to allow the exhaust gases to exit, to allow the fresh charge of air to enter the cylinder 45, and to allow time for the exhaust valve 60 to close.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. An internal combustion engine, comprising:

a) a generally cylindrical crankcase;

b) a plurality of stationary cylinders mounted on the crankcase;

c) a plurality of pistons disposed inside the cylinders;

d) a round crankplate disposed inside the crankcase and capable of rotating therein, an upstanding cylindrical wall formed on the crankplate, the wall having a first end and a second end, the first end of the wall intersecting the crankplate and the second end of the wall having a plurality of perpendicular top portions extending from and overhanging the wall, the top portions defining a cam surface;

e) a plurality of connecting rods, each connecting rod having a first end and a second end, the first end connected to the piston and the second end having a main bearing, the connecting rod connected to the crankplate such that the main bearing engages with and rides on top of the cam surface so that the position of the pistons and the position of the crankplate are interrelated; and, f) an output shaft connected to the crankplate.

2. The apparatus of claim 1, wherein the second end of the connecting rod has at least one stub extending therefrom, the at least one stub engaging the at least one top portions such that main bearing engages with the cam surface.

3. The apparatus of claim 2, wherein the crankcase comprises an inner wall and an outer wall.

4. The apparatus of claim 3, wherein the inner wall and the outer wall have a set of guide rails, the guide rails on the inner wall facing the guide rails on the outer wall.

5. The apparatus of claim 4, wherein the connecting rods are constrained by the guide rails to move in a substantially straight path.

6. The apparatus of claim 4, wherein the connecting rod has a first leg and a second leg, that define a U-shaped opening in the connecting rod.

7. The apparatus of claim 6, wherein the main bearing is mounted in the U-shaped opening.

8. The apparatus of claim 7, wherein the main bearing is mounted on an axle extending through the U-shaped opening.

9. The apparatus of claim 2, wherein the second end of the wall on the crankplate has a top portion having a width greater than the remainder of the wall such that the wall and the top portion form a T-shaped member.

10. The apparatus of claim 9, wherein the T-shaped member on the crankplate fits inside the U-shaped opening in the connecting rod.

11. The apparatus of claim 1, wherein the cam surface has a generally inverted V-shaped profile with a flat portion at the apex of the V.

12. An internal combustion engine, comprising:

a) a crankcase having an inner wall and an outer wall, the inner wall and the outer wall each having a set of guide rails, the guide rails on the inner wall facing the guide rails on the outer wall;

b) a plurality of stationary cylinders mounted on the crankcase;

c) a plurality of pistons disposed inside the cylinders;

d) a crankplate disposed inside the crankcase and capable of rotating therein, the crankplate having a an upstanding cylindrical wall formed thereon, the wall having a first end and a second end, the first end of the wall intersecting the crankplate and the second end of the wall defining a cam surface;

e) a plurality of connecting rods, each connecting rod having a first end and a second end, the first end connected to the piston and the second end having a first leg and a second leg that define a U-shaped opening, a main bearing mounted on an axle extending through the U-shaped opening, the connecting rod connected to the crankplate such that the bearing engages with the cam so that the position of the pistons and the position of the crankplate are interrelated; and, f) an output shaft connected to the crankplate.

13. The apparatus of claim 12, wherein at least two secondary bearings are mounted on the axle outside of the connecting rod.

14. The apparatus of claim 13, wherein the bearings on the outside of the connecting rod are disposed between the guide rails on the crankcase such that the motion of the connectin rods, due to forces from the pistons or the surface on the crankplate, is confined to a substantially straight path.

15. An internal combustion engine, comprising:

a) a crankcase having an inner wall and an outer wall, the inner and outer walls being concentric and cylindrical, the outer wall having a larger diameter than the inner wall, the outer wall having a set of guide rails, the inner wall having a set of guide rails located across from and facing the guide rails on the outer wall, the crankcase having a top plate with a central opening and a plurality of openings positioned around the perimeter of the plate, the crankcase having a bottom plate with a central opening and an inner plate with a central opening;

b) a plurality of stationary cylinders mounted close to the crankcase, the cylinders disposed inside the plurality of openings positioned around the perimeter of the top plate of the crankcase, the cylinders having openings for air intake and having an air exhaust valve;

c) a plurality of pistons disposed inside the cylinders;

d) a plurality of connecting rods, each connecting rod having a first end and second end, the first end connected to the piston and the second end having a first leg and a second leg forming a U-shaped opening therebetween, the first leg and the second leg having stubs at an end, the stubs projecting inwardly to constrict the U-shaped opening, the connecting rod having a main bearing disposed inside the U-shaped opening and mounted on an axle, the connecting rod having at least two secondary bearings mounted on the axle outside the connecting rod, the secondary bearings capable of riding inside the guide rails in the crankcase;

e) a crankplate having an upstanding cylindrical wall formed thereon, the wall having a first end and a second end, the first end of the wall intersecting the crankplate and the second end of the wall having a cam surface defined therein, the second end of the wall having a top portion having a width greater than the remainder of the wall such that the top portion and the wall define a T-shaped member, the T-shaped member capable of fitting inside the U-shaped opening in the connecting rod such that the connecting rod is held onto the T-shaped section by the stubs, the curved surface formed by the T-shaped member capable of engaging with the main bearings on the connecting rods such that the position of the pistons and the position of the crankplate are interrelated; and, f) an output shaft extending through the central opening in the bottom plate and the central opening in the inner plate of the crankcase, and connected to the crankplate such that the crankplate is mounted and rotates between the bottom plate and inner plate of the crankcase.

16. The apparatus of claim 15, wherein an output shaft is rotatably mounted to the crankcase by cup and cone bearings.

17. The apparatus of claim 15, wherein the plurality of openings disposed around the perimeter of the top plate comprise five openings spaced equal distance from each other around the circumference of the plate.

18. The apparatus of claim 15, wherein the cylinder has a plurality of apertures defined therein such that the piston acts as a sliding valve.

19. The apparatus of claim 15, wherein the exhaust valve comprises a lifter valve operated by a push rod.

20. The apparatus of claim 19, wherein the push rod is mechanically engaged by a cam disposed on the surface of the crankplate.

21. The apparatus of claim 20, wherein the push rod further comprises a roller bearing attached to the end of the push rod.

22. The apparatus of claim 15, wherein the top portion of the crankplate has a section where material from the top portion is removed to form an opening in the T-shaped member, the opening being positioned such that counterrotation of the crankplate to a position where the connecting rod aligns with the opening enables the connecting rod to be removed from the T-shaped member.

23. The apparatus of claim 15, further comprising an oil pump disposed inside the crankcase and mechanically coupled to an output shaft.

24. The apparatus of claim 15, further comprising a fuel injection pump disposed inside the crankcase and mechanically coupled to the crankshaft.

25. The apparatus of claim 15, further comprising a gear drive disposed inside the crankcase and coupled to an output shaft.

26. The apparatus of claim 25, wherein the gear drive is connected to a blower positioned inside the crankcase.

27. An internal combustion engine, comprising:

a) a crankcase having an inner wall and an outer wall, the inner wall and the outer wall each having a set of guide rails, the guide rails on the inner wall facing the guide rails on the outer wall;

a) a plurality of stationary cylinders mounted on the crankcase;

b) a plurality of pistons disposed inside the cylinders;

c) a crankplate disposed inside the crankcase and capable of rotating therein, the crankplate having a an upstanding cylindrical wall formed thereon, the wall having a first end and a second end, the first end of the wall intersecting the crankplate and the second end of the wall having a top portion with a width greater than the remainder of the wall such that the wall and the top portion form a T-shaped member, the top portion defining a cam surface;

d) a plurality of connecting rods, each connecting rod having a first end and a second end, the first end connected to the piston and the second end having a bearing, the second end having a first leg and a second leg that define a Ushaped opening, the T-shaped member on the crankplate fitting inside the Ushaped opening in the connecting rod, the connecting rod connected to the crankplate such that the bearing engages with the cam so that the position of the pistons and the position of the crankplate are interrelated; and, e) an output shaft connected to the crankplate.

28. The apparatus of claim 27, wherein the top portion of the crankplate has a section where material from the top portion is removed to form an opening in the T-shaped member, the opening being positioned such that counterrotation of the crankplate to a position where the connecting rod aligns with the opening enables the connecting rod to be removed from the T-shaped member.

29. An internal combustion engine, comprising:

a) a round crankcase having a cylindrical inner wall and a cylindrical outer wall, the inner wall and outer wall each having a set of guide rails, the guide rails on the inner wall facing the guide rails on the outer wall;

b) a plurality of stationary cylinders mounted in a circle and mounted on the crankcase;

c) a plurality of pistons disposed inside the cylinders;

d) a round crankplate disposed inside the crankcase and capable of rotating therein, the crankplate having a cam surface defined therein; and e) a plurality of connecting rods, each connecting rod having a first end and a second end, the first end connected to the piston and the second end having a main bearing and at least two secondary bearings, the connecting rod connected to the crankplate such that the main bearing engages with the cam surface and the at least two secondary bearings engage with the guide rails of the inner crankcase wall and the outer crankcase wall so that the position of the pistons and the position of the crankplate are interrelated, the connecting rods being constrained by the guide rails to move in a substantially straight path.

30. The apparatus of claim 29, wherein the second end of the connecting rod has a first leg and a second leg forming a U-shaped opening therebetween, wherein the main bearing is disposed inside the U-shaped opening and mounted on an axle, and the at least two secondary bearings are mounted on the axle outside the Ushaped opening.

* * * * *